US005174374A

United States Patent [19]

Hailey

[11] Patent Number: 5,174,374

[45] Date of Patent: Dec. 29, 1992

[54] CLEAN-OUT TOOL CUTTING BLADE

[76] Inventor: Charles D. Hailey, 11628 Burning Oaks, Oklahoma City, Okla. 73150

[21] Appl. No.: 779,404

[22] Filed: Oct. 17, 1991

[51] Int. Cl.[5] ..... E21B 10/32; E21B 29/00

[52] U.S. Cl. ..... 166/55.8; 175/263; 175/267

[58] Field of Search ..... 166/55.6, 55.8, 55.7, 166/55.3, 173, 174; 175/267, 268, 269, 284, 286, 263

[56] References Cited

U.S. PATENT DOCUMENTS

| | | | |
|---|---|---|---|
| 309,927 | 12/1884 | Chapman | 175/263 |
| 392,592 | 11/1888 | Douglass | 166/55.8 X |
| 1,494,274 | 5/1924 | Morgan | 175/263 |
| 2,116,903 | 5/1938 | MacClatchie et al. | 175/269 |
| 2,284,170 | 5/1942 | Santiago | 255/76 |
| 2,940,522 | 6/1960 | Taylor et al. | 175/269 X |
| 3,073,389 | 1/1963 | Conner | 166/55.8 |
| 4,431,065 | 2/1984 | Andrews | 175/269 |
| 4,809,793 | 3/1989 | Hailey | 175/265 |
| 5,060,738 | 10/1991 | Pittard et al. | 166/55.8 X |

*Primary Examiner*—Hoang C. Dang

*Attorney, Agent, or Firm*—Laney, Dougherty, Hessin & Beavers

[57] ABSTRACT

A dual blade cutter head for a rotary cutting tool which consists of two identical blades disposed in opposed position, each blade having an outer arcuate edge movable into cutting contact and having suitable hard facing affixed to the arcuate edge oriented for right-turn cutting rotation. In one form the hardface is an arcuate inlay block faced with thermally stable polycrystalline diamond.

3 Claims, 1 Drawing Sheet

CLEAN-OUT TOOL CUTTING BLADE

BACKGROUND OF THE INVENTION

1. Field of the Invention

This invention relates generally to downhole rotary cutting tools and, more particularly, but not by way of limitation, to a clean-out tool cutting blade of the butterfly or expansible type that is capable of cutting different diameter bores within a tubing section without cutting the tubing.

2. Prior Art

The prior art known to Applicant is well characterized in Applicant's previously filed U.S. Pat. No. 4,809,793 as issued on Mar. 7, 1989. This patent describes a rotary clean-out tool of the type that would use the cutting blade that is described in the present application. Thus, the tubing clean-out tool includes fluid pressure responsive linear actuators that function above the cutting blade assemblies to expand and retract the blade to operational attitude.

SUMMARY OF THE INVENTION

The present invention relates to a particular type of cutting blade of the expandable type, i.e. a double blade combination, that is of particular shape and is hardface reinforced at particular points around the cutting edge. Each of the two cutting blades is identical as they function in pairs in opposed position with right-turn edge surfaces formed with selected hardfacing. For example, a synthetic diamond facing pre-formed in a fused block is bonded into an insert space milled around the right-turn edge of the blade.

Therefore, it is an object of the present invention to provide a cutting blade that is rugged and reliable for use in selected tubing clean-out applications.

It is also a object of the present invention to provide a cutting blade combination that can cut through different inner diameters without cutting the inner wall of the tubing containing such restrictive formations.

Finally, it is an object of the present invention to provide a cutting blade having a reinforced hardface of arcuate shape that enables effective abrasion at varying radial distances from the axis of the rotary clean-out tool.

Other objects and advantages of the present invention will be apparent from an understanding of the drawings and detailed descriptions which illustrate the invention.

DETAILED DESCRIPTION OF THE INVENTION

Figure 1:
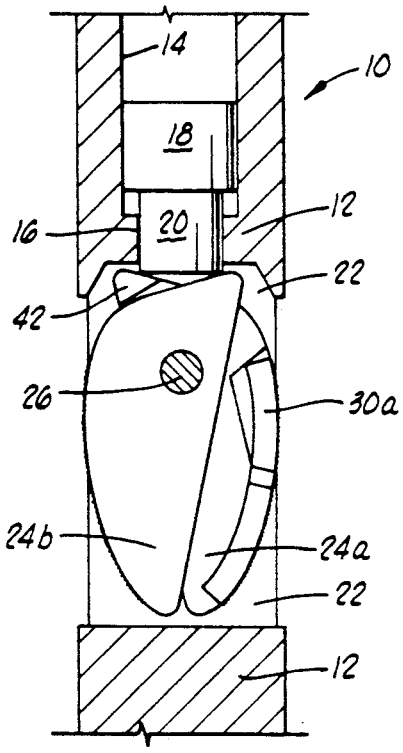
FIG. 1 is a vertical section of a portion of clean-out tool illustrating the cutting blade assembly when in closed position.

FIG. 1 is an idealized sectional view of a portion of rotary clean-out tool 10 such as that described in detail in Applicant's U.S. Pat. No. 4,809,793. Thus, the rotary tool 10 is formed from a cylindrical body member 12 having an axial bore 14 and counterbore 16 with piston 18 and piston rod end 20 received reciprocally therein. The piston 18 is in opposition to drilling fluid under pressure present in axial bore 14. A narrow slotway or transverse cavity 22 then retains a pair of cutting blades **24*a* and 24*b* in opposed disposition as retained on a pivot pin 26**.

Figure 2:
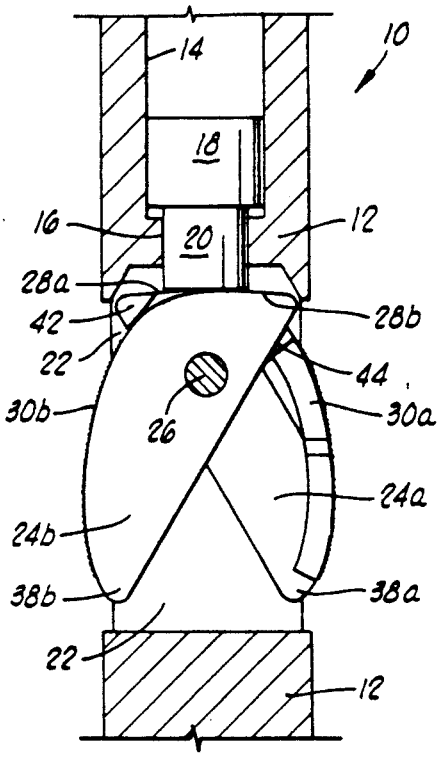
FIG. 2 is a similar section showing the cutting blades in the outward open position.

FIG. 2 shows an attitude when fluid pressure has been increased sufficiently above piston 18 to force the piston downward such that rod end 20 contacts the upper angle edges **28*a* and 28*b* forcing a spread of the opposite ends 38*a* and 38*b* of blades 24*a* and 24*b*, thus presenting an open position for maximum radius cutting. As illustrated, the right-turn facings of blades 28*a* and 28*b* are each inset with a hardface block 30*a* and 30*b*, respectively. It should be understood that there is additional fluid control detail and sealing arrangement provided in tool 10 as well as internal fluid passages that lead around the cavity 22**, and such detail is readily apparent from a study of the U.S. Pat. No. 4,809,793.

Figure 3:
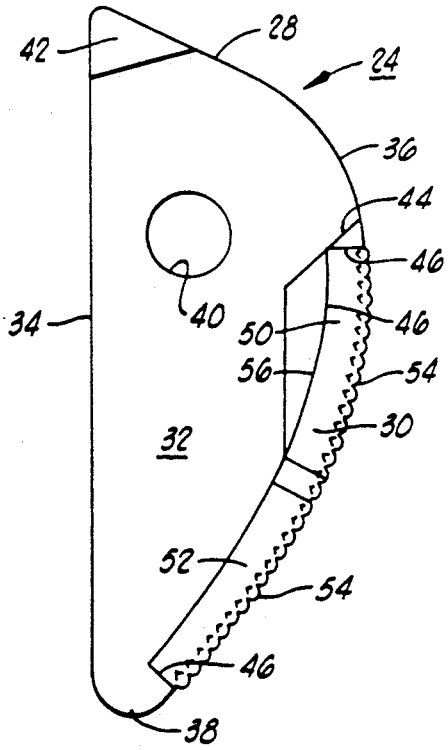
FIG. 3 is a plan view of the right-turn side of a single cutting blade.
Figure 4:
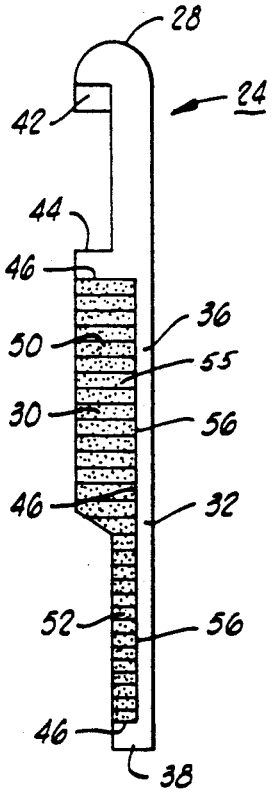
FIG. 4 is an end view of the cutting blade shown in FIG. 3.
Figure 5:
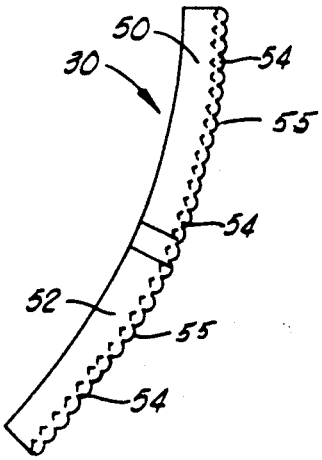
FIG. 5 is a side view of a hard-facing insert block as used in the present invention.

Referring to FIGS. 3, 4 and 5, the various components and configurations of a blade 24 are shown. Thus, the blade 24 consists of a base plate 32 which is formed with a straight side 34, an upper angle edge 28, and an arcuate edge 36 coming to a bottom point 38. A hole 40 receives pivot pin 26. A raised corner surface 42 provides an interlocking surface for contact with the counterpart blade 24, as does a raised facing 44 adjacent the arcuate outer edge 36. An arcuate cut-out of rectangular cross section is formed as milled inset 46 which is formed to receive the hardface insert 30 therein.

The hardface 30 is formed as an insert having an upper, wider portion 50 that tapers to a narrower lower portion 52 while defining a continuous outer surface 54. The insert 30 is a heat/pressure molded formation of suitable sintered or powdered metallic substance and a bonding agent that forms a base for overlay of thermally stable polycrystalline diamond (TSP) 55 which extends completely around the outer surface 54 of wide portion 50 and narrow portion 52. The insert 30 is secured within the inset 46 with silver solder 56, and the blade 32 is then in final form and ready for use with right-turn rotation.

In operation, the rotary tool 10 may be lowered downhole to a work area through existing tubing and, once at a work site, the attendant fluid pressure may be adjusted to compress the piston 18 downward to force rod end 20 against the angle edges **28*a*, 28*b* thereby to expand outward the lower points 38*a* and 38*b* of respective cutter blades 24*a* and 24*b*. The increasing fluid pressure will force the cutter blades 24*a*, 24*b* outward against the existing sediment or deposit at that point and pressure will be maintained until the blades 24 have progressed outward to the inner wall of the tubing whereupon the rotary tool 10** can be moved upward or downward with repetition of the same sequence.

The foregoing discloses a novel cutter blade that is specifically designed in shape and hardfacing to provide abrading function at selected places along a tubing string. It should be understood that other types of hardfacing or cutter elements such as natural diamonds, tungsten carbide inserts, etc. can be employed in substitution. Also, the placement and depth of hardfacing along the arcuate edge of the blades is subject to change, particularly for cutting certain deposits that may be encountered.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A tubing clean-out tool cutting blade of the type used in opposed pairs that are expansibly retained within a rotary cutting tool, comprising:

a base formation having a straight edge and an opposite side arcuate edge having a lower end that comes together with the straight edge at a bottom point;

an upper angle edge joining the straight edge and arcuate edge;

a pivot hole through said base formation proximate the upper angle edge; and a hardface insert of an elongated, arcuate block of metal base having synthetic diamond material insert around a major part of said opposite side arcuate edge wherein the metal base is thicker adjacent the upper angle edge and of reduced thickness at the lower end.

2. A cutting blade as set forth in claim 1 wherein:

said hardface insert is oriented for right-turn rotation.

3. A tubing clean-out tool cutting blade assembly comprising:

a first blade having an arcuate outer edge adjoining an upper angle edge with a pivot hole formed proximate the upper angle edge and having a hardface insert around said arcuate outer edge consisting of a first arcuate block of metal base having thermally stable polycrystalline diamond bonded around the side, said arcuate block being thicker adjacent the upper angle edge and of reduced thickness at a lower end and in orientation for right-turn cutting rotation; and a second blade similar to said first blade with upper angle edge, arcuate outer edge and hardface insert consisting of a second arcuate block of metal base having thermally stable polycrystalline diamond bonded around the outer side, said arcuate block being thicker adjacent the upper angle edge and of reduced thickness at a lower end, and a pivot hole formed near the upper angle edge, and positioned in opposed orientation to said first blade with respective pivot holes aligned.

* * * * *